United States Patent [19]

Kastner

[11] Patent Number: 4,632,129

[45] Date of Patent: Dec. 30, 1986

[54] CIGARETTE MAKING MACHINE

[76] Inventor: Arnold Kastner, 10220 Armand Lavergne, Montreal, Quebec, Canada

[21] Appl. No.: 736,249

[22] Filed: May 21, 1985

[30] Foreign Application Priority Data

Mar. 15, 1985 [CA] Canada ..... 476652

[51] Int. Cl.[4] ..... A24C 5/40; A24C 5/42

[52] U.S. Cl. ..... 131/70; 131/75

[58] Field of Search ..... 131/70–74, 131/75, 76

[56] References Cited

U.S. PATENT DOCUMENTS

| | | | |
|---|---|---|---|
| 2,329,163 | 4/1943 | Reid et al. | 131/70 |
| 3,699,975 | 10/1972 | Saraber | 131/70 |
| 3,741,220 | 6/1973 | Meinunger | 131/70 |
| 3,903,902 | 9/1975 | Messner et al. | 131/70 |
| 3,927,681 | 12/1975 | Bramhill | 131/70 |

FOREIGN PATENT DOCUMENTS 909105 9/1972 Canada .

*Primary Examiner*—V. Millin

*Attorney, Agent, or Firm*—Balogh, Osann, Kramer, Dvorak, Genova & Traub

[57] ABSTRACT

The machine which is of lightweight, compact and economical construction has an elongate base having formed on its upper surface at one end a tobacco receiving and compacting chamber and a cover having a tobacco compactor mounted on its lower surface pivotally mounted on the base and movable from open tobacco insertion position to closed tobacco compacting position where the tobacco compactor forms a cylindrical chamber in the recess. One end of the recess is closed by a removable plate carrying an injection nipple and tobacco formed in the cylindrical chamber is transferred by a reciprocally movable injection spoon through the nipple and into a preformed cigarette tube positioned on the nipple. The nipple and injection spoon are easily removable from the machine for cleaning or replacement.

10 Claims, 9 Drawing Figures

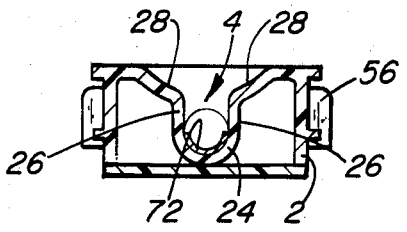
FIG. 6
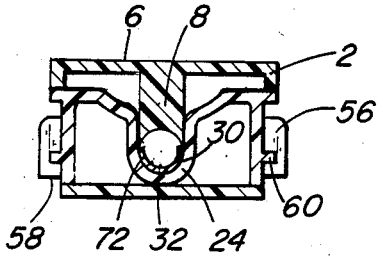
FIG. 7
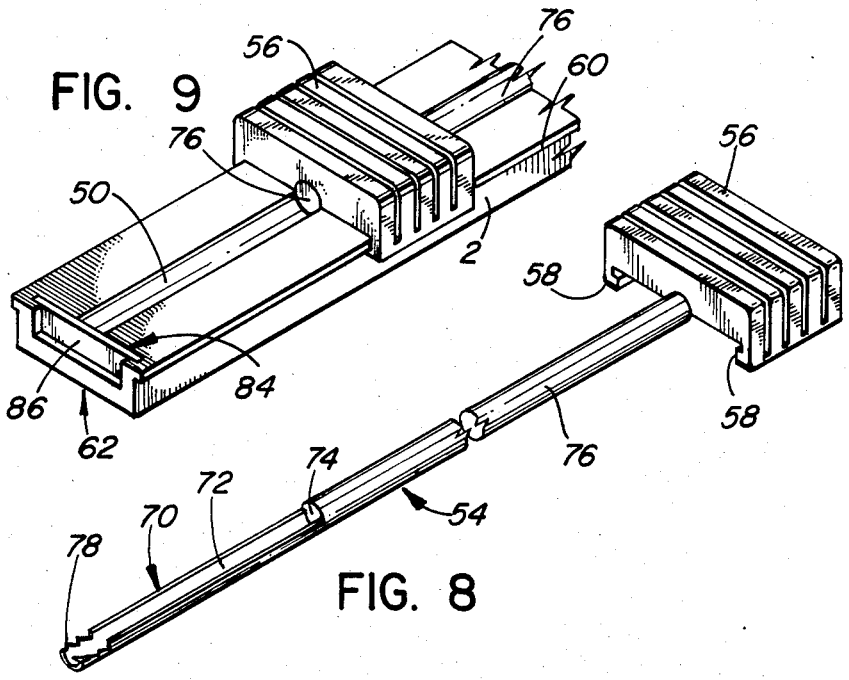
FIG. 9
FIG. 8

CIGARETTE MAKING MACHINE

The present invention relates to a small, compact, lightweight and economically manufactured cigarette making machine, and particularly to a cigarette making machine of the injection type wherein a supply of tobacco is compacted into cylindrical form and injected into a preformed cigarette tube positioned on the machine.

The machine of this invention has an elongate base having formed on its upper surface at one end a tobacco receiving and compacting recess, and a cover for the recess having on its lower surface a tobacco compactor pivotally connected to the base and movable between open tobacco receiving and closed tobacco compacting positions. When the tobacco compactor is lowered into the recess, an elongate cylindrical chamber is defined for the forming of a supply of tobacco of similar shape therein. The cover slidably carries releasable locking means used to secure the cover in closed compacting position with respect to the base. A circular opening is formed in an end wall of the tobacco recess and in axial alignment with the cylindrical chamber, and a hollow nipple of circular cross-section having an outer diameter to snugly receive an open end of a cigarette tube therearound projects axially outwardly from around the opening. The front wall of the cover bears against the nipple when the cover is in closed position to hold a cigarette tube thereon during insertion of a supply of tobacco therein. An injection handle is slidably and removably mounted on the upper surface of the base at its other end and to which is secured a tobacco injection spoon having a concave upper surface and which is reciprocably movable, upon movement of the injection handle from a position forming a bottom in the tobacco recess to a position projecting through and extending outwardly from the said circular opening and nipple and into a cigarette tube positioned thereon.

The primary object of the invention is to provide a cigarette making machine which is economical in manufacture and which uses only a small number of moving parts which avoids the complexities and disadvantages of prior machines of this general type. A further feature of the invention is the ease of and simplicity of disassembly of working component parts for cleaning and replacement.

THE PRIOR ART

Machines of the type wherein a supply of tobacco is compacted into cylindrical form by the pivoted lowering of a cover to compact the tobacco followed by the injection of the compacted tobacco into a pre-formed cigarette tube positioned on a nipple which is in axial alignment with the tobacco forming cavity are known. In this regard, reference is made to Canadian Patent No. 909,105, issued Sept. 5, 1972, in the name of GizehWerk GmbH., which provides apparatus for the injection of a compacted supply of tobacco into a preformed cigarette tube positioned in axial alignment with the tobacco chamber. In the arrangement of this patent the cigarette tube is held on the nozzle by a rather complicated spring-loaded assembly which is subject to wear during usage and is susceptible to malfunction due to the formation of tobacco gum which is unavoidable and disassembly of this spring-loaded assembly for cleaning is not possible with the assembly of this patent. With the apparatus of this patent, moreover, the cleaning of the various movable parts which contact and transfer the tobacco and which inevitably accummulate tobacco gum is most difficult and as these moving components are the one most subject to wear, the inability to be able to conveniently replace defective parts results in an assembly which has a limited useful life.

On the other hand, appilcant's injection spoon assembly and nipple arrangement which require the most frequent cleaning and possible replacement are mounted on the machine for easy removal and replacement and which enable the user of the present machine to quickly and easily clean or replace parts as required in a manner not before possible with known machines.

A further difficulty with machines of the type disclosed in Canadian Patent No. 909,105 and similar machines is that only soft and hotter-smoking cigarettes having insufficient tobacco can be satisfactorily made. If in the use of the machine according to this patent, a user attempts to add excess tobacco to obtain a firmer cooler-smoking cigarette then injection becomes very difficult and the extra force involved often results in a breakage of the machine particularly in the area where the cover is pivotally connected to the base.

This difficulty is avoided by the present invention primarily through the use of a slide wedge-lock arrangement to secure the cover to the base which enables firmer cooler-smoking cigarettes to be made while still providing for ease of injection without machine damage.

The present inventive concept will now be more specifically described with reference to the accompanying drawings wherein like reference numberals refer to like parts.

BRIEF DESCRIPTION OF DRAWINGS

FIG. 6 is a sectional view taken along line VI—VI of FIG. 2;

FIG. 7 is a sectional view taken along line VII—VII of FIG. 1;

FIG. 8 is a perspective view of the injection spoon-/injection handle assembly; and FIG. 9 is a rear perspective view of a portion of the machine illustrating a stop plate alternative.

DETAILED DESCRIPTION OF THE ACCOMPANYING DRAWINGS

Figure 1:
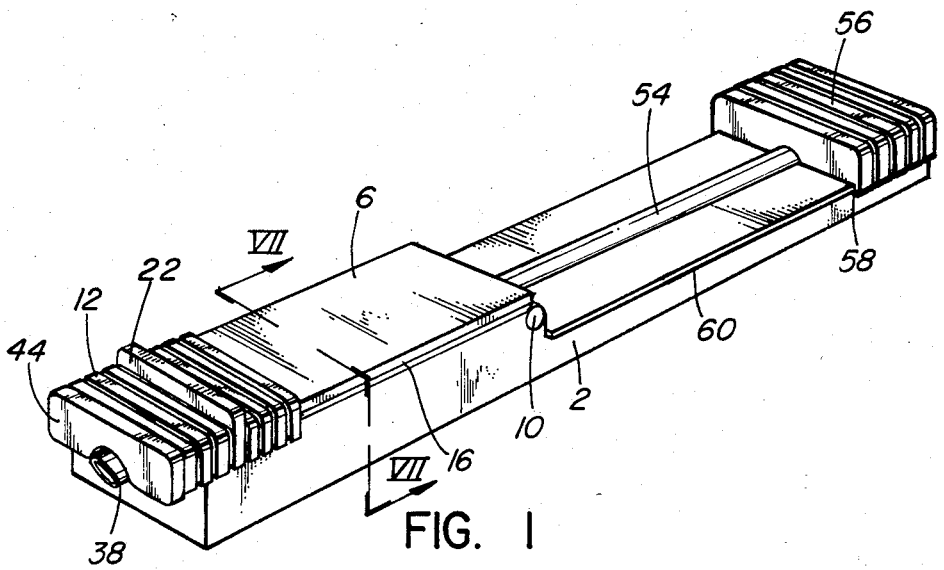
FIG. 1 is a perspective view of the present machine with the cover of the tobacco compacting chamber in closed position.
Figure 2:
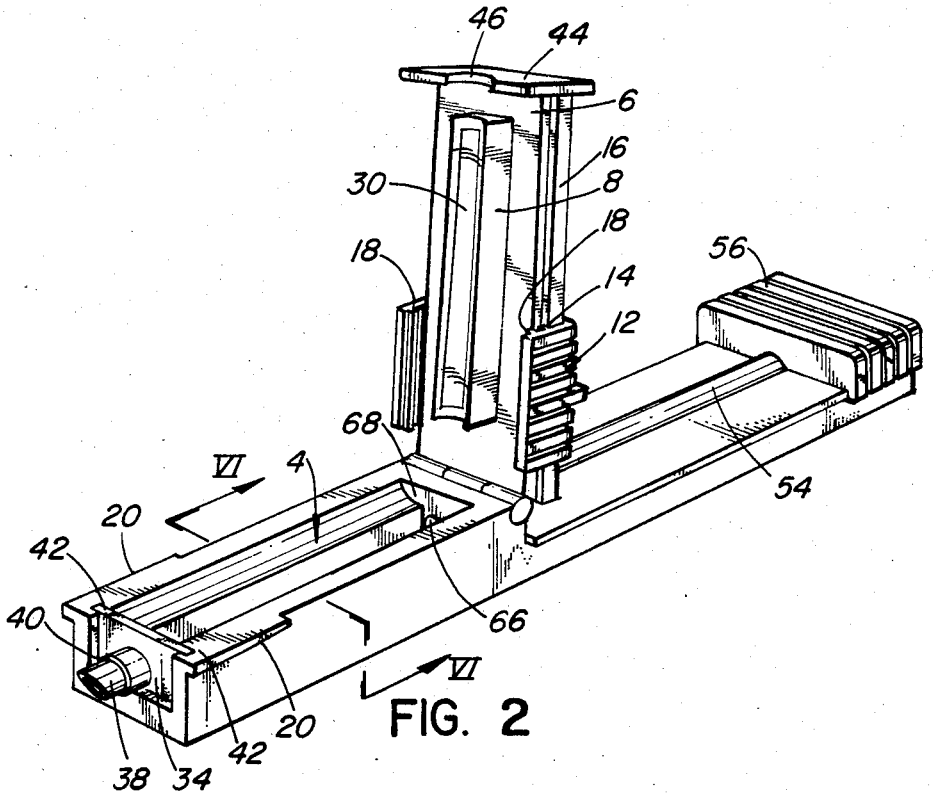
FIG. 2 is a perspective view of the machine according to FIG. 1 and showing the cover in open position.

The present machine comprises an elongate base 2 having formed on its upper surface at one end a tobacco receiving and compacting recess 4 (see FIG. 2). A cover 6 having on its lower surface a tobacco compactor 8 is pivotally secured as at 10 to the base 2 with the cover being pivotable between an open tobacco receiving position as shown in FIG. 2 to a closed tobacco compacting position as shown in FIGS. 1 and 4.

Figure 4:
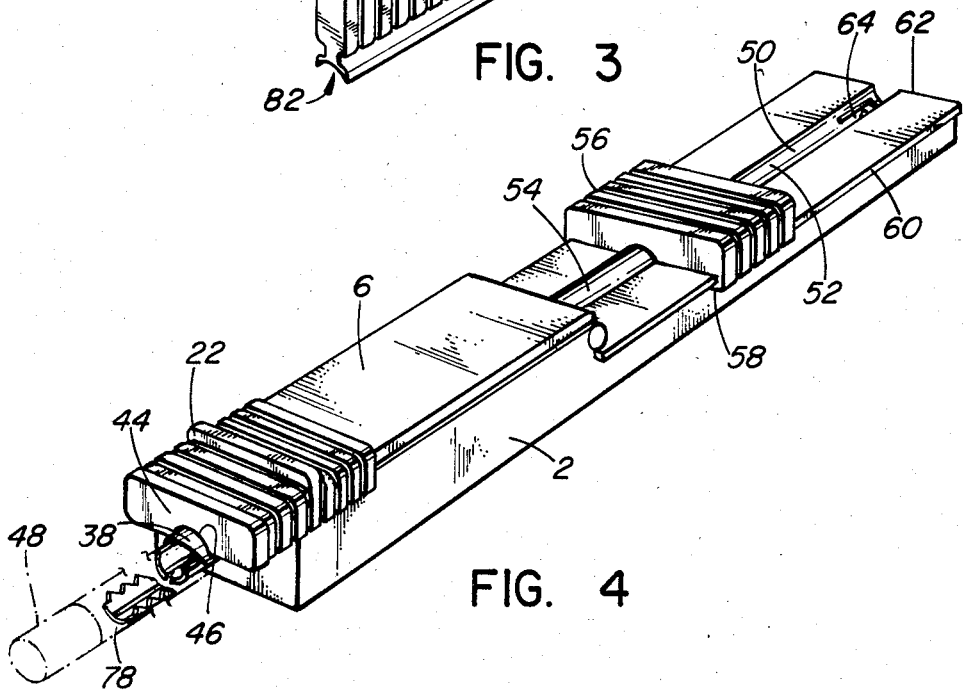
FIG. 4 is a perspective view of the machine similar to FIG. 1 but showing forward movement of the injection handle and attached injection spoon.

Locking means in the form of locking bridge 12 is carried by the cover 6 and is slidable therealong from the cover open position shown in FIG. 2 to the cover locking and tobacco compacting position at the forward end of the machine as shown in FIGS. 1 and 4. In the assembly shown, the locking bridge 6 is of inverted generally channel shape which straddles the cover and the downwardly extending sides (not numbered) are provided with inwardly directed ribs 14 which are positioned below side edges 16 provided along opposed sides of the cover and which relationship holds the locking bridge on the cover while enabling sliding movement therealong.

The inner side surfaces of the locking bridge 12 are also provided with a second set of inwardly directed ribs 18 which when the cover is in closed position and the locking bridge is moved from the rearward position shown in FIG. 2 to the forward locking position as shown in FIGS. 1 and 4, engage beneath tapered outwardly extending flanges 20 provided on each side of the base to securely tighten the cover with respect to the base.

To facilitate this locking movement of the cover, the locking bridge may, if desired, by provided with a raised rib projection 22 as shown in FIGS. 1 and 4.

The tobacco receiving and compacting recess is shown generally at 4 in FIG. 2, and this recess is shown in section in FIG. 6. In the showing in FIG. 6 the cover 6 is in the open tobacco receiving position but for simplicity the cover is not specifically shown.

As clearly shown in FIG. 6, the tobacco recess 4 has a lower semi-circular surface 24 with upwardly extending sides 26 which flare outwardly and upwardly into concavely curved surfaces 28 which assist in the proper positioning of the tobacco within the recess and before the cover is closed and locked.

As shown in FIGS. 2 and 7, the lower surface of the cover 6 is provided with an elongate tobacco compactor 8 having a concavely curved lower surface 30 extending throughout its length which when the cover is closed forms with the semi-circular lower surface 24 of the recess a cylindrical cavity 32 within which the tobacco is molded into cylindrical form and ready for injection into the open end of a preformed cigarette tube which may be of the plain end or filter tip variety.

Figure 5:
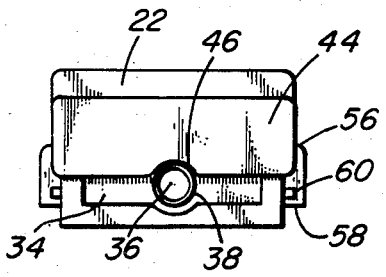
FIG. 5 is a view of the forward end of the machine.

The forward end of the tobacco recess 4 is closed by plate 34 having a circular opening 36 (see FIG. 5) surrounded by an outwardly extending hollow cigarette tube supporting nipple 38 and through which opening and nipple a cylindrical wad of tobacco is injected into a preformed cigarette tube position on the nipple as will be discussed below. As shown in FIG. 2, the nipple may be stepped or provided with a shoulder 40 extending therearound against which the end of a cigarette tube abuts when the tube is mounted on the nozzle. This step or shoulder facilitates precise positioning of the cigarette tube on the nipple.

In preferred construction, the plate 34 carrying the nipple 38 is removably mounted on the base to facilitate cleaning and replacement should this be necessary and conveniently enables the selection of a nipple 38 of proper size depending upon the diameter of the preformed cigarette tube being used. In this regard, cigarette tubes in use in Europe are slightly smaller in diameter than the tubes in use in North America. Conveniently, and to provide for easy removal and replacement of the plate 34 the sides of the base need simply be provided with slots 42 (see FIG. 2) to receive the side edges (not numbered) of the plate.

The lower edge of the front wall 44 of the cover 6 is provided with a concavely shaped recess 46 which when the cover is closed and locked, bears against the nipple 38 and this securely holds a cigarette tube 48 positioned on the nipple (see FIG. 4) during injection of the tobacco wad into the tube.

The upper rear surface 50 of the base is provided with a longitudinally extending semi-circular groove 52 to slideably receive the lower portion of a tobacco injection spoon 54 which for full understanding is illustrated in FIG. 8 in perspective view in assembly with an injection handle 56.

The groove 52 extends into the tobacco recess 4 and forms the lower surface 24 of the recess as will be understood from FIGS. 6 and 7 and provides guiding support for the injection spoon during its reciprocal sliding movement.

The injection handle 56 is formed with downwardly depending side walls (not numbered) which have inwardly directed ribs 58 which engage beneath outwardly extending flanges 60 provided along the sides of the base and which interengagement holds the injection handle on the base while at the same time permitting reciprocal movement of the injection handle and the injection spoon from the rearward position shown in FIGS. 1 and 2 to a forward tobacco injecting position as shown in FIG. 4.

As will be seen from FIG. 4, the groove 52 extends through the rearward end 62 of the base and is provided with a resilient upwardly biased stop 64 to limit rearward movement of the injection handle with respect to the base and prevent inadvertent sliding movement of the injection handle off of the base. As indicated however, the stop is of a resilient nature and with additional force, it is possible to override the stop and remove the injection handle and spoon completely from the base to facilitate cleaning or replacement of the spoon and cleaning of the injection chamber to remove tobacco "gum" from the assembly which is occasioned primarily by the use of fresh or high moisture tobacco. The removal and replacement of the injector handle and injection spoon is very simply and quickly accomplished and permits the user to keep the machine in clean condition for maximum cigarette forming performance.

The injection spoon 54 extends forwardly from the injection handle 56 through a circular opening 66 formed in wall 68 defining the rearward end of the tobacco recess (see FIG. 2) and as shown in FIGS. 6 and 7, the forward portion 70 of the spoon which has a concave upper surface 72 as shown in FIG. 8 provides the lower surface of the cylindrical chamber 32 and it is partially against this concave surface 72 of the spoon that the tobacco is formed into cylindrical shape ready for injection into a cigarette tube.

Forward movement of the injection handle from the rearward position shown in FIGS. 1 and 2 to the advancing forward position shown in FIG. 4 results in a corresponding movement of the forward end 70 of the injection spoon through the nipple 38 as shown in FIG. 4 and into a cigarette tube 48 positioned on the nozzle.

The shoulder 74 provided on the spoon between its forward concave portion 70 and its rearward cylindrical portion 76 bears against the compacted tobacco during forward movement of the spoon to transfer the tobacco from the cylindrical chamber into the cigarette tube. This pushing movement of the shoulder on the tobacco ensures that the tobacco is inserted into the tube to a position in contact with the interior surface of the filter plug of the cigarette tube and guards against the formation of any empty spots within the finished cigarette which is a problem which does occur in some known cigarette makers.

As shown in FIGS. 4 and 8, at least the end of the tobacco compacting spoon may be serrated as at 78 to further assist in the transfer of the tobacco from the cylindrical chamber forwardly into the cigarette tube.

Figure 3:
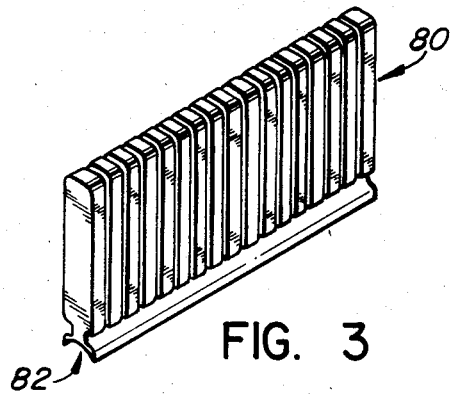
FIG. 3 is a tobacco tamper suitable for use with the present machine.

When one wishes to prepare a cigarette, the injection handle 56 is moved rearwardly on the base to the position a shown in FIGS. 1 and 2, and with the locking bridge 12 in the position shown in FIG. 2, the cover 6 is opened to the position also shown in FIG. 2. A cigarette tube 48 is then mounted on the injection nozzle 38 as shown in FIG. 4 and a supply of tobacco sufficient for one cigarette is positioned in the tobacco recess 4 and between the sides 26 and this is facilitated by the concavely curved surfaces 28 and also through the use of a suitable tamper 80 such as shown in FIG. 3 and which as shown, may have a lower surface 82 of concave shape to assist in forming the tobacco into cylindrical shape in the cylindrical chamber prior to the lowering of the tobacco compactor 8. The cover is then closed and the locking bridge 12 moved forwardly to the position shown in FIG. 4 to securely lock the cover on the base. This closing movement of the cover lowers the tobacco compactor 8 into compression contact with the tobacco forming the tobacco into a generally cylindrical shape. With the locking of the cover on the base the recessed edge 46 on the front wall of the cover bears against the cigarette tube 48 positioned on the nipple 38 and securely holds the tube thereon. The user then simply slides the injector handle forwardly from the position shown in FIGS. 1 and 2 to the advancing position shown in FIG. 4 which results in forward movement of the injection spoon 54 which carries the tobacco into the cigarette tube positioned on the nipple. When this injection is complete, the injection handle is then simply moved rearwardly to the position shown in FIGS. 1 and 2, and the locking bridge also moves rearwardly to the position shown in FIG. 2 and the cover lifted to enable removal of the completed cigarette from the nipple. The lower surface 82 of the tamper 80 may alternatively simply be flat.

As indicated earlier, the flanges 20 provided on the base are tapered or slightly wedge-shaped with the result that during forward movement of the locking bridge the tobacco in the cylindrical chamber is compressed to an increasingly precise degree to provide for proper compaction while at the same time permitting sufficient looseness in the tobacco to enable the tobacco to be injected into the tube with comfortable injection pressure. The present sliding locking bridge arrangement prevents an overloading of tobacco in the recess for with excess tobacco the bridge will not easily slide forwardly to close the cover to its fully closed position, and the user is then aware that some tobacco should be removed. This avoids wastage and facilitates the injection of properly packed cigarettes.

FIG. 9 illustrates an alternative stop arrangement for guarding against inadvertent sliding removal of the injection handle 56 and associated injection spoon 54 from the base 2 while providing simple means enabling removal when desired for cleaning and/or replacement as discussed earlier.

As shown in FIG. 9, and adjacent the rearward end 62, the base 2 is provided with a slot 84 to slideably and removably receive a stop plate 86 and which of course when it is positioned on the base will prevent further rearward sliding movement of spoon 54 and handle 56 within groove 50.

To remove the spoon 54 and injection handle 56 assembly from the base, the stop plate 86 which is removably slideably positioned in slot 84 need simply be removed. The plate 84 will then of course be replaced when the spoon/injection handle assembly is re-positioned on the base.

In preferred construction, many if not all of the components of the present machine may be molded from suitable plastic material, although manufacture of the machine using other materials or combinations of materials is within the scope of the present invention. If desired, the injection nipple and the injection spoon may be of metal construction.

I claim:

1. A cigarette making machine of the type wherein a supply of tobacco is formed into elongate shape and then inserted into a preformed cigarette tube positioned on the machine, comprising an elongate base having formed on its upper surface at one end a tobacco receiving and compacting recess and a cover for the tobacco recess having on its lower surface a tobacco compactor pivotally connected to the base and pivotable between open tobacco receiving and closed tobacco compacting positions, the tobacco recess and the tobacco compactor defining therebetween when the cover is closed, an elongate cylindrical chamber for the forming of a supply of tobacco of similar shape therein, releasable locking means slidably carried by the cover to secure the cover in closed tobacco compacting position with respect to the base, a circular opening formed in an end wall of the base closing the tobacco recess and in axial alignment with the cylindrical chamber, and a hollow nipple of circular cross-section having an outer diameter to snugly receive an open end of a cigarette tube therearound projecting axially outwardly from around the opening, the cover having a front wall which bears against the nipple when the cover is closed to hold a cigarette tube thereon during insertion of a supply of tobacco therein, and an injection handle slidably and removably mounted on the upper surface of the base at its other end and to which is secured a tobacco insertion spoon having a concave upper surface and which is reciprocally movable, upon movement of the injection handle, from a position within the tobacco recess to a position projecting through and extending outwardly from the said circular opening and nipple and into a cigarette tube positioned thereon.

2. A machine according to claim 1, wherein the said locking means is a locking bridge of inverted generally channel shape having downwardly extending sides which have inwardly directed ribs which during forward movement of the locking bridge engage beneath tapered outwardly projecting flanges provided on each side of the base to tightly secure the cover to the base.

3. A machine according to claim 1 wherein the lower edge of the front wall of the cover is provided with a concave recess to bear against the nipple when the cover is closed to hold a cigarette tube in position on the nipple during tobacco insertion.

4. A machine according to claim 1 wherein the said end wall of the base having the circular opening is a plate removably secured to the base to which the nipple is secured.

5. A machine according to claim 1 wherein the nipple is provided with a step or shoulder against which a cigarette tube abuts during positioning.

6. A machine according to claim 1 wherein the injection spoon has a forward end formed with said concave upper surface and a rearward portion of elongate cylindrical shape providing a circular shoulder which bears against the tobacco wad during insertion of the tobacco into a tube.

7. A machine according to claim 1, wherein the injection spoon rides in a semi-circular groove which extends the length of the base and forms a lower surface in the tobacco recess, and a resilient upwardly biased stop provided in the groove adjacent the said other end of the base to prevent inadvertent removal of the injection handle and injection spoon from the base.

8. A machine according to claim 1 wherein the tobacco recess formed in the base has a lower surface of concave semi-cylindrical cross-section with upwardly extending sides which flare outwardly and upwardly into surfaces of concave configuration to facilitate positioning of tobacco in the chamber.

9. A machine according to claim 8 wherein the tobacco compactor is of elongate shape having a concavely curved lower surface which extends the length thereof and which when the cover is closed extends downwardly between the parallel sides of the tobacco recess to form therewith the said cylindrical chamber.

10. A machine according to claim 1 wherein side edges at the forward end of the injection spoon are serrated to facilitate transfer of the tobacco wad into a cigarette tube.

* * * * *